United States Patent [19]

Weiss

[11] 4,230,417

[45] Oct. 28, 1980

[54] MODULE FOR MODULAR TROPHY BASE

[75] Inventor: Allen Weiss, Chicago, Ill.

[73] Assignee: Alamar Associates, Glenview, Ill.

[21] Appl. No.: 12,826

[22] Filed: Feb. 16, 1979

[51] Int. Cl.[3] ..... B25G 3/00

[52] U.S. Cl. ..... 403/301; 285/176; D11/131

[58] Field of Search ..... 285/176, 177; 52/103, 52/104; D11/131, 157; 403/301

[56] References Cited

U.S. PATENT DOCUMENTS

| | | | |
|---|---|---|---|
| D. 166,740 | 5/1952 | Dodge | D11/131 X |
| 1,771,176 | 7/1930 | Holub | 285/176 |
| 3,421,781 | 1/1969 | Spurk | 285/176 |
| 3,754,724 | 8/1973 | Osowski | D11/131 X |

FOREIGN PATENT DOCUMENTS

| | | | |
|---|---|---|---|
| 2513328 | 10/1976 | Fed. Rep. of Germany | 285/176 |

*Primary Examiner*—Andrew V. Kundrat

*Attorney, Agent, or Firm*—Vogel, Dithmar, Stotland, Stratman & Levy

[57] ABSTRACT

A transition module is provided for use in constructing a modular trophy base including one or more column modules having end plates at the upper and lower ends thereof. The transition module includes a hollow closed peripheral wall having opposite ends, the perimeters of which respectively define predetermined closed figures which are substantially different from each other in shape and/or size. Each of these ends is adapted for mating engagement with the end plate of an associated correspondingly-shaped column module, with the hollow end of the transition module disposed in surrounding press-fitted relationship with a raised portion of the end plate. Thus, the transition module may be used at each end of a single column module to provide transition between the column module and other members, or may be used to provide the transition between two different column modules.

10 Claims, 5 Drawing Figures

MODULE FOR MODULAR TROPHY BASE

BACKGROUND OF THE INVENTION AND PRIOR ART STATEMENT

The present invention relates to trophy bases, and in particular, to trophy bases of modular construction, i.e., formed of a plurality of interchangeable standardized parts or modules connected together to form different sizes and shapes of trophy base.

Such modular trophy bases are made by applicant's assignee. Each base is typically an assembly of a pedestal and one or more column modules, each column module preferably being hollow and being closed at the upper and lower ends thereof by an end plate. The end plates are provided with central openings therethrough for receiving an elongated connecting rod which extends vertically through the entire assembly and is threadedly secured at one end thereof to the pedestal and at the other end thereof to the trophy statuette or other emblem.

The foregoing arrangement is old and is the closest prior art of which applicant is aware.

This prior art arrangement has permitted interconnection of column modules of different heights, but has been limited to the interconnection of column modules having substantially the same transverse cross section. This necessarily limits the variety of trophy base designs which can be achieved by the use of the prior art modules.

SUMMARY OF THE INVENTION

The present invention relates to a modular trophy base construction which permits interconnection of column modules of different size and shape to afford a much greater variety of trophy base designs.

It is a general object of the present invention to provide a transition module for use in combination with column modules and end plates to achieve a modular trophy base construction.

More specifically, it is an object of this invention to provide a transition module which has two opposite ends of different size and/or shape which are respectively matably connectable with correspondingly-shaped column modules to provide transition therebetween or transition between a column module and some other member in the trophy construction.

It is another object of this invention to provide a transition module of the character described, which is hollow and which may be coupled to the end plates of the modular trophy base construction in the same manner as the column modules are coupled thereto.

These and other object of the invention are achieved by providing a transition module for use in constructing a modular trophy base which includes a column module having end plates at the upper and lower ends thereof, the transition module comprising a closed peripheral side wall having two opposite ends, the perimeter of one of the ends of the side wall defining a first predetermined closed figure and the perimeter of the other of the ends of the side wall defining a second predetermined closed figure substantially different from the first figure, at least one of the ends of the side wall being shaped and dimensioned for mating engagement with the end plate of an associated column module, whereby the transition module may form a transition between the associated column module and another member.

Further features of the invention pertain to the particular arrangement of the parts of the transition module whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
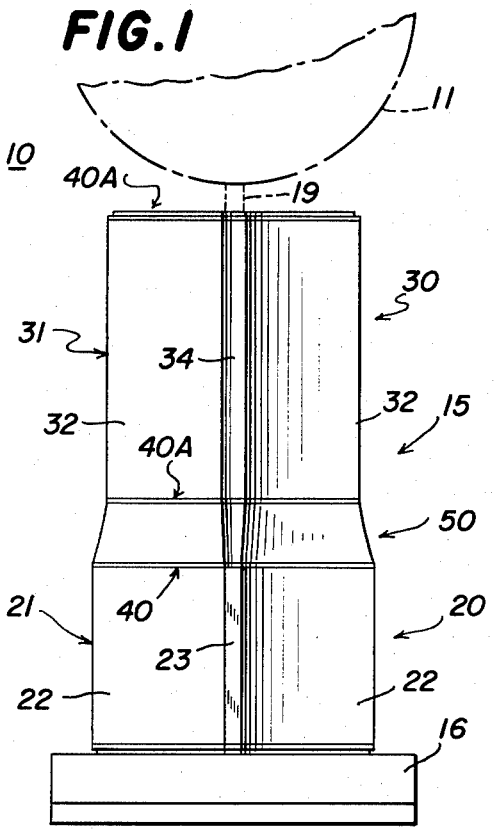
FIG. 1 is a front elevational view of a modular trophy base utilizing the transition module of the present invention.
Figure 2:
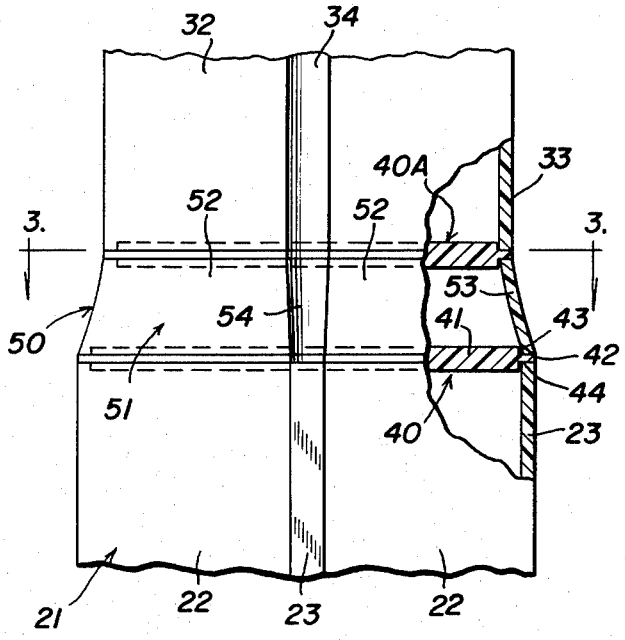
FIG. 2 is an enlarged fragmentary view in partial vertical section of the modular trophy base of FIG. 1, and in particular the transition module portion thereof.

Referring to FIGS. 1 and 2 of the drawings, there is illustrated a trophy, generally designated by the numeral 10, which includes a figurine 11 which is typically in the shape of some person or object representative of the activity for which the trophy is to be awarded, and a base, generally designated by the numeral 15, on which the figurine 11 is supported. The base 15 includes a pedestal 16 to which is connected one end of a connecting rod 19 which extends vertically upwardly through the base 15 and is adapted to be connected at its upper end to the figurine 11. Typically, threaded coupling means are provided at the upper and lower ends of the connecting rod 19 for attachment to the pedestal 16 and figurine 11.

Figure 3:
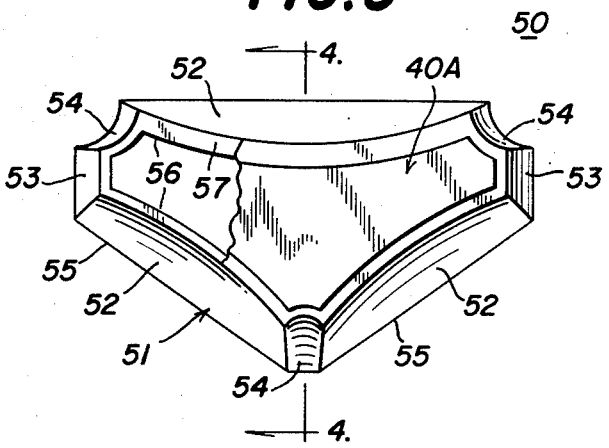
FIG. 3 is a view in horizontal section taken along the line 3—3 in FIG. 2, with a portion of the end plate broken away more clearly to show the transition module construction.

The base 15 also includes a relatively wide column module 20 provided at the upper and lower ends thereof with end plates 40 and a relatively narrow column module 30 provided at the upper and lower ends thereof with end plates 40A, and a transition module 50 disposed between the column modules 20 and 30. The column modules 20 and 30 have transverse cross sections of similar, but not identical shape, and of substantially different size, the transition module 50 having a transverse cross section which varies from that of the column module 20 to that of the column module 30, as is best illustrated in FIG. 3.

More particularly, the wide column module 20 is preferably hollow and includes a closed peripheral side wall 21 comprising eight wall sections, including three relatively large wall sections 22 arranged in a generally triangular configuration, three relatively small wall sections 23 respectively disposed generally at the corners of the triangular configuration, and two concave corner sections 24. Each of the wall sections 22 and 23 is a flat, planar, vertically-extending section.

The narrow column module 30 is also preferably hollow and includes a closed peripheral side wall 31 comprising a plurality of wall sections, including three large wall sections 32, two relatively small wall sections 33 and three concave corner sections 34, arranged generally in the same manner as was described above with respect to the wide column module 20. But while the relatively small wall sections 33 are flat, planar vertically-extending sections, the relatively large wall sections 32 are slightly concave.

The end plates 40 at the upper and lower ends of the column module 20 are identically constructed, each having substantially the same peripheral outline as the adjacent end of the column module 20. More particularly, the end plate 40 includes a main body 41 having a peripheral flange 42 extending laterally outwardly therefrom around the entire perimeter thereof intermediate the upper and lower surfaces thereof and spaced from those surfaces for cooperation therewith to define upper and lower coupling shoulders or ledges 43 and 44. In like manner, each of the end plates 40A disposed at the upper and lower ends of the column module 30 are identically constructed, each having a peripheral outline corresponding to the adjacent end of the column module 30, but is otherwise of the same flanged and shouldered construction as the end plate 40.

Referring in particular to FIG. 2, the end plate 40 at the upper end of the column module 20, for example, is dimensioned and arranged so that the peripheral flange 42 thereof rests upon the upper edge of the peripheral side wall 31 of the column module 30, so that the peripheral side wall 31 is disposed in surrounding relationship with the lower portion of the main body 41 of the end plate 40 in press or snap-fitting engagement therewith. The end plates 40A are coupled to the column module 20 in the same manner. Preferably, each of the end plates 40 and 40A is provided with a circular aperture therethrough centrally thereof for receiving the connecting rod 19 therethrough. Each of the column modules 20 and 30, the end plates 40 and 40A, the pedestal 16 and the connecting rod 19 is a prior art structure.

Figure 4:
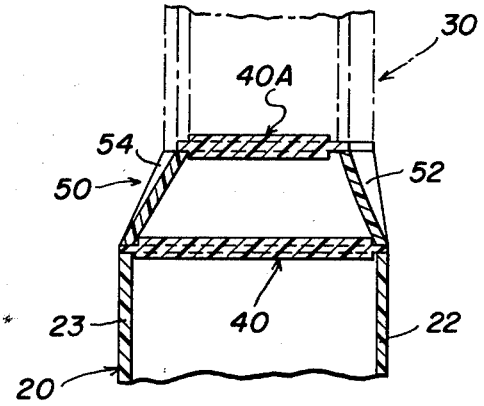
FIG. 4 is a reduced view in vertical section taken along the line 4—4 in FIG. 3.

Referring now also to FIGS. 3 and 4 of the drawings, the transition module 50 of the present invention is generally similar in shape to each of the column modules 20 and 30, and is of hollow construction including a peripheral closed side wall 51 comprising eight wall sections. More particularly, the side wall 51 includes three relatively large wall sections 52 and two relatively small wall sections 53 and three concave corner sections 54 arranged generally in the same relationship as the corresponding wall sections of the narrow column module 30, described above. But each of the wall and corner sections 52 through 54 of the side wall 51 is inclined with respect to the longitudinal axis of the peripheral side wall 51 so that the perimeter of the side wall 51 at one end thereof is substantially smaller than the perimeter of the side wall 51 at the other end thereof. Also, while the end edges of the wall sections 52 and 53 and the front one of the corner sections 54 are straight lines at one end thereof, as at 55, the end edges of these wall sections at the other ends thereof are arcuate, as at 56. The side wall 51 has a predetermined thickness so as to define end surfaces 57 at the opposite ends thereof, the end surfaces 57 lying in parallel planes.

Thus, the transverse cross section of the transition module 50 at one end thereof is substantially identical to the transverse cross section of the wide column module 20, while the transverse cross section of the transition module 50 at the other end thereof is substantially identical to the transverse cross section of the narrow column module 30. Similarly, the perimeter of the peripheral side wall 51 at the large end thereof defines a closed figure which is adapted for mating and press-fitting engagement with one of the end plates 40, while the perimeter of the side wall 51 at the other end thereof defines a closed figure which is adapted for mating and press or snap-fitting engagement with one of the end plates 40A.

Thus, it will be appreciated that the transition module 50 may be interposed between the column modules 20 and 30 for providing a transition therebetween, as illustrated in FIGS. 1 and 2. When assembled, the end surfaces 57 of the peripheral side wall 51 are respectively disposed in mating engagement with the peripheral flanges 42 of the end plates 40 and 40A and in surrounding press-fitting relationship with the adjacent portions of the main body 41 of the end plates 40 and 40A.

While, in the embodiment illustrated in the drawings, the transition module 50 has been designed to provide a transition between column modules 20 and 30 of generally similar shape but different size, it will be appreciated that the transition module 50 could also be designed for providing a transition between column modules of completely different shape.

Figure 5:
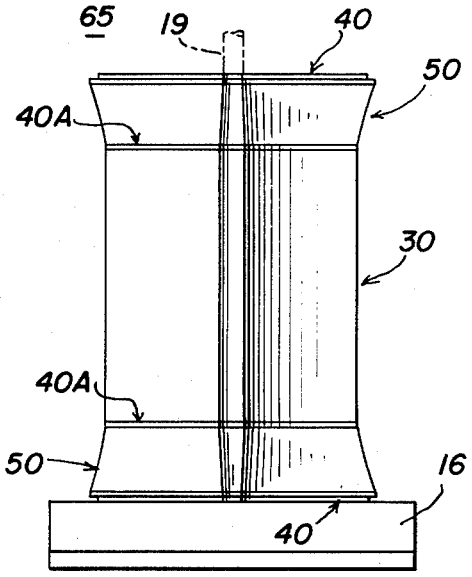
FIG. 5 is a front elevational view similar to FIG. 1, but showing another type of trophy base construction which can be achieved by the use of the transition module of the present invention.

Referring now also to FIG. 5 of the drawings, there is illustrated a trophy base, generally designated by the numeral 65, which utilizes a slightly different combination of modules to achieve a different effect. More particularly, the trophy base 65 includes a single narrow column module 30 closed at the upper and lower ends thereof by end plates 40A, each of which is in turn coupled to a transition module 50. There is thus formed a base which is generally in the form of a column having outwardly flared upper and lower ends. The lower transition module 50 has the lower end thereof closed by an end plate 40 which is in turn coupled to a pedestal 16, while the upper transition module 50 has the upper end thereof closed by an end plate 40 for supporting an associated figurine thereon, the parts all being held together by a connecting rod 19 in the same manner as was described above in connection with the trophy 10 of FIG. 1. In this regard, there is preferably provided a nut or other suitable member threadedly engaged with the connecting rod 19 adjacent to the upper end thereof for positioning therealong to engage the end plate of the upper end of the trophy base so as to hold the parts thereof tightly together in their assembled condition.

In a constructional model of the present invention, the transition module 50, as well as each of the column modules 20 and 30 and the end plates 40 and 40A are formed of a suitable plastic, shaped and decorated as desired. It will be appreciated, however, that other suitable materials could be used.

From the foregoing, it can be seen that there has been provided a transition module for a modular trophy base construction which is adapted for coupling to other modules to provide a wide variety of trophy base designs and constructions.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A transition module for use in constructing a modular trophy base which includes a column module having end plates at the upper and lower ends thereof, said transition module comprising a closed peripheral side wall having two opposite ends, the perimeter of one of said ends of said side wall defining a first predetermined closed figure and the perimeter of the other of said ends of said side wall defining a second predetermined closed figure substantially different from said first figure, at least one of said ends of said side wall being shaped and dimensioned for mating engagement with an end plate of the associated column module, the other of said ends of said side wall being shaped and dimensioned for mating engagement with an end plate of another associated member, whereby said transition module may form a transition between the associated column module and another member.

2. The transition module of claim 1, wherein said peripheral side wall is hollow.

3. The transition module of claim 1, wherein said peripheral side wall is formed of plastic.

4. The transition module of claim 1, wherein each of said ends of said side wall is shaped and dimensioned for mating engagement with the end plate of an associated column module.

5. The transition module of claim 1, wherein each of said closed figures is irregular in shape.

6. The transition module of claim 1, wherein said irst and second closed figures are similar in shape but substantially different in size.

7. The transition module of claim 1, wherein said opposite ends of said side wall respectively lie in parallel planes.

8. A transition module for use in constructing a modular trophy base which includes a column module having end plates at the upper and lower ends thereof, said transition module comprising a closed peripheral side wall having two opposite ends and including a plurality of flat planar wall sections and a plurality of concave wall sections, the perimeter of one of said ends of said side wall defining a first predetermined closed figure and the perimeter of the other of said ends of said side wall defining a second predetermined closed figure substantially different from said first figure, at least one of said ends of said side wall being shaped and dimensioned for mating engagement with an end plate of the associated column module, whereby said transition module may form a transition between the associated column module and another member.

9. A transition module for use in constructing a modular trophy base which includes first and second column modules of different transverse cross section and each having at each of the upper and lower ends thereof an end plate provided with a peripheral coupling ledge surrounding a raised body portion, said transition module comprising a hollow closed peripheral side wall having two opposite ends, the perimeter of one of said ends of said side wall defining a first predetermined closed figure and the perimeter of the other of said ends of said side wall defining a second predetermined closed figure substantially different from said first figure, one of said ends of said side wall being shaped and dimensioned for mating engagement with the coupling ledge of an end plate of the first column module in surrounding relationship with the raised body portion thereof, the other of said ends of said side wall being shaped and dimensioned for mating engagement with the coupling ledge of an end plate of the second column module in surrounding relationship with the raised body portion thereof, whereby said transition module may be coupled to each of said first and second column modules for forming a transition therebetween.

10. The transition module of claim 9, wherein each of said ends of said side wall is adapted to be pressfitted around the raised body portion of the associated column module end plate.

* * * * *